United States Patent [19]

Kawamura et al.

[11] Patent Number: 4,825,067

[45] Date of Patent: Apr. 25, 1989

[54] COUPLING MEANS FOR ALIGNING FIBER OPTIC BUNDLES BETWEEN X-RAY IMAGE INTENSIFIER AND IMAGE PICKUP TUBE

[75] Inventors: Shigeharu Kawamura; Yoshiharu Obata, both of Ootawara; Yuichi Fujimoto, Tochigi; Kinya Kabashima, Ootawara, all of Japan

[73] Assignee: Kabushiki Kaisha Toshiba, Kawasaki, Japan

[21] Appl. No.: 136,960

[22] Filed: Dec. 23, 1987

[30] Foreign Application Priority Data

Dec. 25, 1986 [JP] Japan ..... 61-307968

[51] Int. Cl.[4] ..... H01J 31/50; H01J 40/15

[52] U.S. Cl. ..... 250/213 VT; 313/2.1; 313/372; 313/482

[58] Field of Search ..... 313/372, 2.1, 482; 250/213 VT; 350/96.22

[56] References Cited

U.S. PATENT DOCUMENTS 3,058,021 10/1962 Dunn ..... 313/65
3,624,442 11/1971 Smithgall et al. ..... 313/372
3,638,057 1/1972 Janssen ..... 313/2.1
4,603,250 7/1986 Contini et al. ..... 250/213 VT
4,633,076 12/1986 Butterwick ..... 250/213 VT
4,758,763 7/1988 Gorton ..... 313/482

*Primary Examiner*—David C. Nelms
*Assistant Examiner*—William L. Oen
*Attorney, Agent, or Firm*—Cushman, Darby & Cushman

[57] ABSTRACT

An X-ray television apparatus includes an X-ray image intensifier and an imaging unit. The X-ray image intensifier converts an X-ray image into a visible image. The visible image is transmitted to the imaging unit by optical fiber bundles coupled with each other by a coupling mechanism. The imaging unit converts the visible image into an electrical signal of an image. Bolts are threadably engaged with a flat ring base provided to the X-ray image intensifier. By an elastic pressure of coil springs into which the bolts are inserted, a holding member provided to the coupling mechanism couples the imaging tube to the X-ray image intensifier via the optical fiber bundles. An electrostatic shielding film is formed on a surface of the holding member and prevents a pseudo signal generated by the X-ray image intensifier from entering the imaging unit, thereby reducing the noise components contained in the electrical signal of an image.

14 Claims, 3 Drawing Sheets

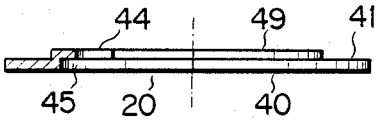
FIG. 5A
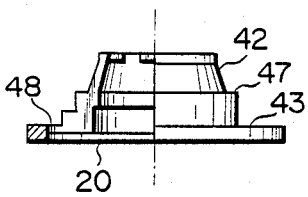
FIG. 6A
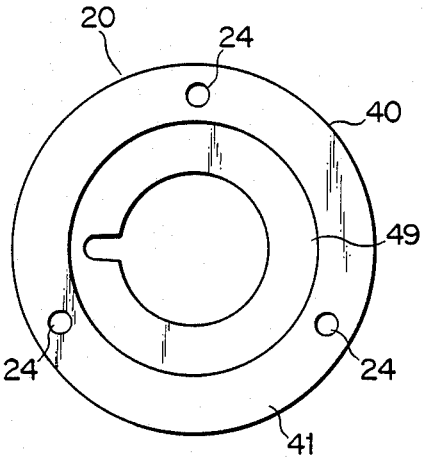
FIG. 5B
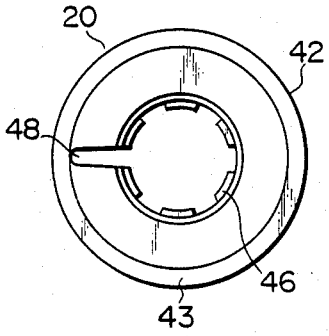
FIG. 6B
FIG. 7A
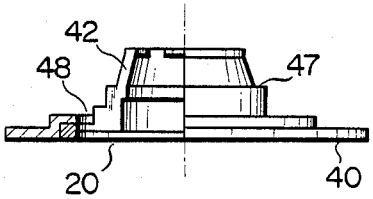
FIG. 7B
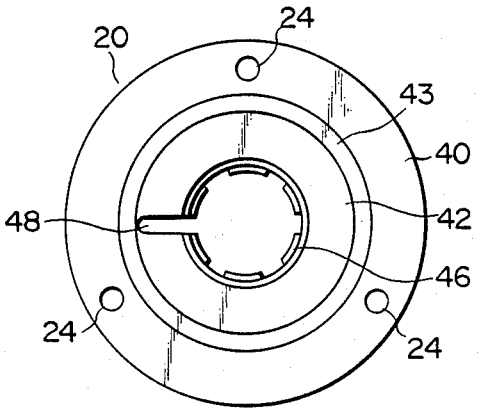

COUPLING MEANS FOR ALIGNING FIBER OPTIC BUNDLES BETWEEN X-RAY IMAGE INTENSIFIER AND IMAGE PICKUP TUBE

BACKGROUND OF THE INVENTION

The present invention relates to an X-ray television apparatus and, more particularly, to a structure for coupling an X-ray image intensifier with an imaging unit.

X-ray television apparatuses are now widely employed in such fields as medicine and industry. Typically X-rays are generated by an X-ray generator and transmitted through a subject/object under examination, with the resultant X-ray image being incident on the input phosphor screen of the X-ray image intensifier incorporated in the X-ray television apparatus, where it is converted into a visible image, and this visible image is converted into photoelectrons by a photoelectric surface. These photoelectrons are focused and accelerated by electrodes to form an electron image on an output phosphor screen of the X-ray image intensifier, and this electron image is converted into a visible image by the output phosphor screen. The visible image from the X-ray image intensifier is transmitted to a photoconductive film of an imaging unit and is converted into an electrical signal. Conventionally, this visible image is transmitted from the X-ray image intensifier to the imaging unit as follows. That is, an optical lens system or an optical fiber optical system is known as transmitting means. In an apparatus adopting an optical lens system, the visible image from the output phosphor screen of the X-ray image intensifier is transmitted through a tandem lens system as the optical lens system and is imaged on the photoconductive film of the imaging unit. In an apparatus adopting the optical fiber optical system, as described in U.S. Pat. Nos. 3,058,021 and 3,967,123, the visible image is directly incident on an optical fiber bundle, transmitted therethrough, and then imaged on the photoconductive film of the imaging unit. The optical fiber optical system has better light transmission efficiency than that of the optical lens system. Therefore, the X-ray television apparatus having the optical fiber optical system does not have a lens and hence can be advantageously made compact in size. However, in the X-ray television apparatus having the optical fiber optical system, a visible image output end face of an optical fiber bundle connected to the output phosphor screen of the X-ray image intensifier must be optically coupled with accuracy and reliability to a visible image input end face of an optical fiber bundle connected to the photoconductive film of the imaging unit. As such an optical coupling structure for satisfying the above requirement, a diaphragm structure is described in U.S. Pat. No. 3,967,123. This diaphragm structure is a disk which has a central open portion and a plurality of lugs extending spirally from a ring portion toward the center. Tips of the lugs are engaged with a rim of the imaging unit, and the X-ray image intensifier is coupled to the imaging unit by an elastic pressure of the diaphragm, thereby optically coupling the two optical fibers. However, a structure of couple means using the diaphragm having the lugs poses the following problems. That is, in this structure, since the elastic pressure of the plate-like diaphragm changes quadratically with respect to a displacement amount, it is difficult to set the elastic pressure. In addition, since the diaphragm has gaps between the lugs, an electric field generated from a portion near an output section of the X-ray image intensifier enters into the imaging unit as electrical noise, thereby generating a pseudo signal as noise from the photoconductive film of the imaging unit. This pseudo signal degrades an S/N ratio of the imaging unit and hence degrades frequency characteristics of the X-ray television apparatus. Furthermore, since the elastic pressure is applied on the rim of the imaging unit by the lug tips of the diaphragm engaged therewith, a load is concentrated onto an engaged portion and the rim tends to be distorted. As a result, a vacuum seal capacity of the imaging unit and transmission efficiency of an output signal may be degraded. Moreover, since the tips of the lugs are brought into contact with the rim of the imaging unit by the elastic pressure of the diaphragm, perfect surface contact cannot be obtained. As a result, an optical axis of the optical fiber at the side of the X-ray image intensifier is largely deviated from that of the optical fiber at the side of the imaging unit.

SUMMARY OF THE INVENTION

It is, therefore, an object of the present invention to provide an X-ray television apparatus in which reliability is improved by couple means capable of easily setting an elastic pressure and having an electrostatic shielding effect for interrupting electrical noise.

This X-ray television apparatus comprises: an X-ray image intensifier for converting an incident X-ray image into a visible light image; an imaging unit for converting the visible light image into a video signal; optical fibers for transmitting the visible light image of the X-ray image intensifier to the imaging unit; and couple means for coupling the optical fibers to the X-ray image intensifier and the imaging unit by an elastic pressure.

BRIEF DESCRIPTION OF THE DRAWINGS

FIGS. 5A to 7B are axial partially sectional views and radial plan views showing modifications of the holding member shown in FIG. 3.

DETAILED DESCRIPTION OF THE PREFERRED EMBODIMENT

An X-ray television apparatus according to an embodiment of the present invention will be described below with reference to the accompanying drawings.

Figure 1:
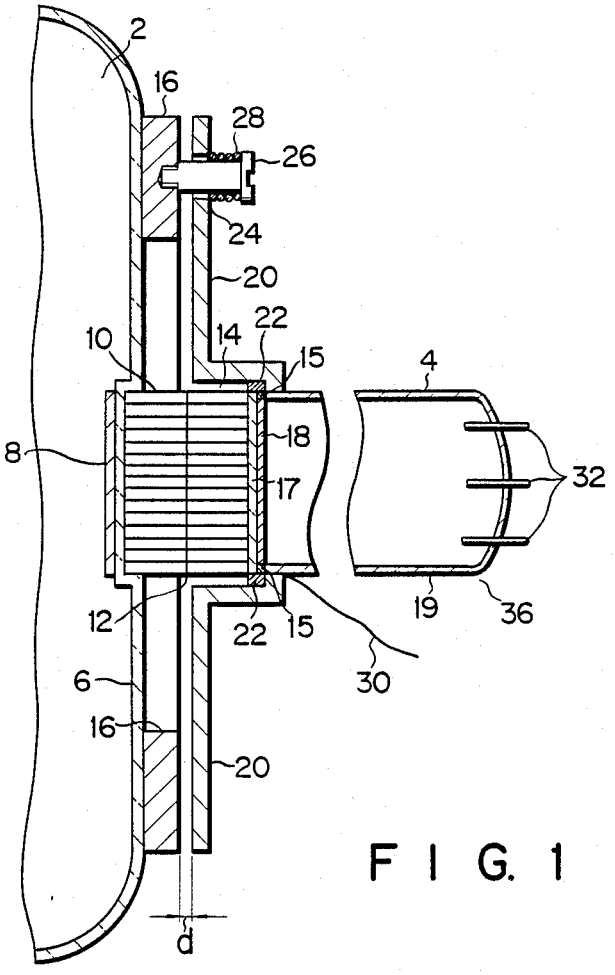
FIG. 1 is a longitudinal sectional view schematically showing part of an X-ray television apparatus according to an embodiment of the present invention.

As shown in FIG. 1, the X-ray television apparatus includes X-ray image intensifier 2 for converting an X-ray image into a visible image and pickup tube 4 for converting the visible image into an electrical signal of an image. In intensifier 2, an input phosphor screen (not shown) for converting the X-ray image into the visible image is formed on an X-ray image input surface of envelope 6, and a photoelectric surface (not shown) for converting the visible image from the input phosphor screen into photoelectrons is formed on the input phosphor screen. In addition, in intensifier 2, a focusing electrode (not shown) for focusing the photoelectrons and an accelerating electrode (not shown) for accelerating the photoelectrons are arranged in envelope 6, and output phosphor screen 8 for converting the photoelectrons into the visible image is formed on an output surface of envelope 6 where the photoelectrons are focused. Tube 4 includes face plate 17 and tube portion 19. Plate 17 and an opening portion of tube portion 19 are coupled with each other and sealed by indium member 15 as a sealing member. Target ring 22 is fixed around a coupled portion between plate 17 and tube portion 19. An electron gun (not shown) for generating an electron beam is provided in tube portion 19. Photoconductive film 18 for converting and outputting an electrical signal in accordance with an incident visible image is formed on an inner surface of plate 17. The electron beam generated by the electron gun scans film 18, and the electrical signal corresponding to the incident visible image is generated from scanned film 18. This electrical signal is extracted from signal line 30 connected to film 18. In order to apply a high voltage to an electrode (not shown) of the electron gun, stem pin 32 is mounted on stem pin mounting portion 3 of tube portion 19.

An X-ray image incident on intensifier 2 is formed when X-rays generated from an X-ray generator are transmitted through an object to be examined. This X-ray image is incident on the input phosphor screen and converted into a visible image. This visible image is incident on the photoconductive surface and converted into photoelectrons. The photoelectrons are focused by the focusing electrode (not shown) of intensifier 2 and at the same time accelerated by the accelerating electrode (not shown) thereof, thereby forming an electron image on output phosphor screen 8 provided on the output surface of envelope 6 of intensifier 2. This electron image is converted into a visible image on output phosphor screen 8 In order to transmit the visible image to tube 4, first optical fiber bundle 10 is connected to the surface of envelope 6 opposite to output phosphor screen 8. Second optical fiber bundle 14 aligned with first optical fiber bundle 10 is connected to film 18 of tube 4. A light output end face of bundle 10 and that of bundle 14 are coupled with each other at optical fiber coupling surface 12. The visible image converted by output phosphor screen 8 is transmitted to bundle 14 from bundle 10 through optical fiber coupling surface 12. The visible image transmitted from bundle 14 is transmitted to film 18 and is converted into an electrical signal of an image. This electrical signal is transmitted to a video unit (not shown) by signal line 30, and the X-ray image is reproduced.

Figure 2:
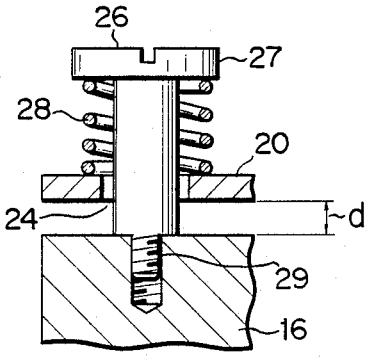
FIG. 2 is a longitudinal sectional view showing a fixing portion of a fiber coupling structure shown in FIG. 1.
Figure 3A:
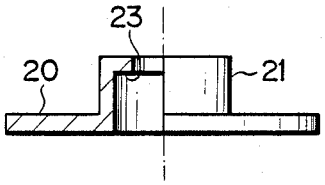
FIGS. 3A and 3B are an axial partially sectional view and a radial plan view showing a holding member of the fiber coupling structure shown in FIG. 1.
Figure 3B:
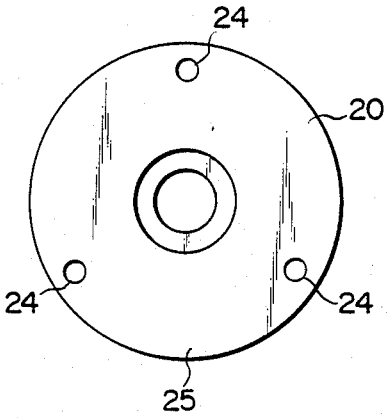

Two optical fiber bundles 10 and 14 are held between intensifier 2 and tube 4 by holding member 20 and are optically coupled with each other. As shown in FIG. 3, holding member 20 has disk 25 having a circular opening portion at its central portion, and cylinder portion 21 extends axially from a peripheral portion of the circular opening portion of disk 25. Cylinder portion 21 has inner peripheral portion 23 to be engaged with tube 4 at its opening portion. Tube 4 is inserted from stem pin mounting portion 36 into the central opening portion of holding member 20, and target ring 22 of tube 4 is engaged with inner peripheral portion 23 of holding member 20. Three insertion holes 24 are axial-symmetrically formed in disk 25. Bolt 26 (shown in FIG. 2) having threaded portion 29 which is thinner than a bolt shank is inserted into each hole 24 through coil spring 28. A diameter of spring 28 is set larger than that of hole 24. Therefore, spring 28 is compressed between bolt head 27 of bolt 26 and a surface region of holding member 20 around hole 24. Threaded portion 29 of bolt 26 is threadably engaged with a screw hole formed in flat ring base 16 fixed to image intensifier 2. In this case, a gap having predetermined distance d is formed between base 16 and holding member 20 so that springs 28 compressed between bolt heads 27 and holding member 20 apply a predetermined elastic pressure to holding member 20.

As described above, in this optical coupling structure, three bolts 26 are inserted into three holes 24, and three compressed springs 28 are arranged on the surface regions of holding member 20 around holes 24. Therefore, by holding member 20, bundle 10 is aligned with bundle 14, and intensifier 2 and tube 4 are reliably coupled with each other and maintained in this state.

In this optical coupling structure, holding member 20 is held by the elastic pressure of springs 28. The elastic pressure of springs 28 changes linearly with respect to a displacement amount. Therefore, a change amount of the elastic pressure is small, and hence a predetermined elastic pressure can be easily set. For this reason, holding member 20 is rarely deformed after a long time period of use, and the optical coupling structure almost does not change. Unlike the diaphragm structure, tube 4 is not held by the elastic pressure of holding member 20, but holding member 20 is held by the elastic pressure of springs 28. Therefore, a material for forming holding member 20 is not limited to those used in the conventional diaphragm structure. That is, holding member 20 may be formed of a variety of materials such as aluminum, permalloy, or ceramic. In addition, when tube 4 is inserted into the opening portion of holding member 20 and ring 22 of tube 4 is engaged with inner peripheral portion 23 of holding member 20, no gap is formed between holding member 20 and tube 4. As a result, tube 4 is shielded from the electric field generated from intensifier 2. More preferably, an electrostatic shielding film may be formed on a rear surface of holding member 20 by depositing or plating a conductive layer of, e.g., aluminum, gold, or copper, so that holding member 20 can be reliably shielded from the electric field. As a result, the electric field generated at a portion near the output section of intensifier 2 is prevented from entering into tube 4 as electrical noise, thereby reducing noise components contained in the electrical signal of an image.

Furthermore, holding member 20 according to the present invention uniformly holds ring 22 by its inner peripheral portion 23. Therefore, the coupling portion between plate 17 and tube portion 19 of tube 4 sealed by indium member 15 is not distorted, thereby preventing destruction of a vacuum seal of tube 4 or the like.

Figure 4:
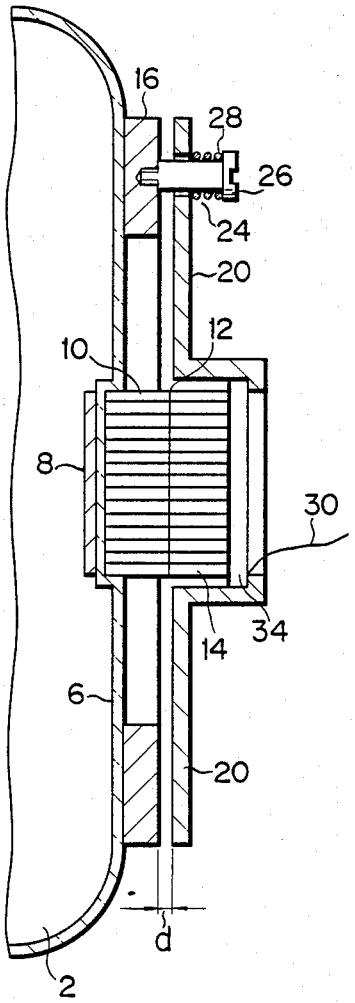
FIG. 4 is a longitudinal sectional view schematically showing part of an X-ray television apparatus according to a modification of the present invention.

FIG. 4 shows a modification of the embodiment shown in FIG. 1. In this modification, CCD 34 as a solid-state image sensor is used instead of pickup tube 4. CCD 34 is coupled to optical fiber bundle 14, and a visible light image transmitted through bundle 14 is incident on CCD 34. CCD 34 converts the visible light image into an electrical signal and transmits the signal to signal line 30. Since CCD 34 is compact as compared with tube 4, the imaging unit can be made compact by replacing tube 4 with CCD 34.

FIGS. 7A and 7B show a modification of holding member 20 used instead of that shown in FIG. 3 and obtained by combining two members formed of different materials. Holding member 20 is constituted by disk-like base 40 shown in FIGS. 5A and 5B and target ring mounting member 42 shown in FIGS. 6A and 6B. Base 40 includes large-diameter portion 41 and small-diameter portion 49 connected to large-diameter portion 41 through step portion 45. Three insertion holes 24 are formed axial-symmetrically in large-diameter portion 41. Bolt 26 is inserted in each hole 24, and threaded portion 29 of bolt 26 is threadably engaged with a screw hole of base 16. Bolt 26 is inserted in compressed coil spring 28, and a diameter of spring 28 is set larger than that of hole 24. Therefore, since springs 28 are compressed between bolt heads 27 and the surface regions around holes 24 of base 40, a gap having predetermined distance d is formed between flat ring base 16 and disk-like base 40. As a result, a predetermined elastic pressure is applied on the surface regions around holes 24 by springs 28. For this reason, base 40 is formed of a material which is less deformed, e.g., aluminum. U-shaped signal line extracting hole 44 is formed in a circular opening portion of a central portion of base 40. Since mounting member 42 which is the other member constituting holding member 20 is engaged with pickup tube 4, it is formed of an insulating material, e.g., a synthetic resin material so as to be insulated from tube 4. Target ring mounting member 42 includes substantially cylindrical portion 47. Substantially cylindrical portion 47 has ring-like flange 43 extending from one end of the opening portion in a direction perpendicular to the axial direction, and a plurality of tongues 46 to be engaged with target ring 22 of tube 4 on the inner surface at the other end of the opening portion. U-shaped signal line extracting hole 48 is formed in the opening portion of substantially cylindrical portion 47. Base 40 and mounting member 42 constituting holding member 20 are combined as shown in FIGS. 7A and 7B. That is, mounting member 42 is inserted coaxially from substantially cylindrical portion 47 into the central opening portion of base 40. In addition, flange 43 of mounting member 42 is engaged with step portion 45 of base 40 so that hole 44 of base 40 and hole 48 of mounting member 42 overlap each other. As a result, mounting member 42 is mounted on base 40. In this state, when ring 22 of tube 4 is engaged with tongues 46 of mounting member 42, base 40 and mounting member 42 are used as holding member 20.

Instead of coil springs 28, leaf springs as elastic members or cylinders as air springs may be used. In addition set pins may be used in place of bolts 26.

The present invention can be applied not only to X-rays but also to other rays such as gamma rays or to visible light.

In order to optically couple the optical fibers connected to the X-ray image intensifier with those connected to the imaging unit, the holding member couples the X-ray image intensifier with the imaging unit by a plurality of couple means provided on its peripheral portion. Therefore, the elastic pressure can be easily set. In addition, since the holding member can apply a constant pressure to the entire peripheral portion of the target ring of the pickup tube, the target ring is not distorted, thereby improving vacuum seal capacity of the pickup tube. Furthermore, since no gap is formed when the pickup tube is mounted on the holding member, electrical noise generated from the X-ray image intensifier can be prevented from entering into the imaging unit. Therefore, the X-ray television apparatus can provide a sufficient intensity within a limited load range, thereby improving its reliability.

What is claimed is:

1. An X-ray television apparatus comprising:

an X-ray image intensifier for converting an incident X-ray image into a visible image;

an imaging unit for converting the visible image into an electrical signal of an image;

two optical fiber bundles, respectively connected to said X-ray image intensifier and said imaging unit, for transmitting the visible image converted by said X-ray image intensifier to said imaging unit; and coupling means for aligning said two optical fiber bundles and coupling said X-ray image intensifier with said imaging unit by means of elastic pressure, said coupling means having a holding member for holding said imaging unit and an elastic fixing member for applying the elastic pressure to said holding member, so as to hold said imaging unit against said X-ray image intensifier.

2. An apparatus according to claim 1, wherein said imaging unit includes a tube portion, a face plate, a photoconductive film formed thereon for converting the visible image into the electrical signal, a sealing member for sealing said face plate to said tube portion, and a target ring fixed around said sealing member.

3. An apparatus according to claim 1, wherein said holding member includes a disk having a circular opening at its center and a cylindrical portion extending axially from a periphery of the circular opening of said disk and engaged with said target ring of said imaging unit at an inner peripheral portion of said opening of said cylindrical portion.

4. An apparatus according to claim 1, wherein said elastic fixing member has screws threadably engaged with said X-ray image intensifier and coil springs into which said screws are inserted compressedly between said holding member and said X-ray image intensifier.

5. An apparatus according to claim 1, wherein said holding member has an electrostatic shielding film for shielding against electrical noise generated by said X-ray image intensifier.

6. An apparatus according to claim 5, wherein said electrostatic shielding film is a conductive layer.

7. An apparatus according to claim 6, wherein said conductive layer is a plated layer or a deposition layer of aluminum.

8. An apparatus according to claim 2, wherein said holding member has a target ring mounting member for supporting said target ring of said imaging unit, and a disk-like base coupled to said target ring mounting member and supported against said X-ray image intensifier by said elastic fixing member.

9. An apparatus according to claim 8, wherein said target ring mounting member includes a ring-like flange and a substantially cylindrical portion having a circular opening at the center thereof, and said substantially cylindrical portion has a plurality of tongue portions projecting inward from one end of the opening.

10. An apparatus according to claim 9, wherein said tongue portions can be elastically deformed and engaged with said target ring.

11. An apparatus according to claim 8, wherein said disk-like base includes a large-diameter portion and a small-diameter portion joined thereto by means of a step portion.

12. An apparatus according to claim 11, wherein said substantially cylindrical portion of said target ring-mounting member is inserted into the central opening portion of said disk-like base, and said flange of said target ring mounting member is engaged with said step portion of said disk-like base, so that said disk-like base is brought into tight contact with said target ring mounting member.

13. An apparatus according to claim 11, wherein said disk-like base is formed of aluminum.

14. An apparatus according to claim 2, wherein said holding member includes a disk having a circular opening at its center and a cylindrical portion extending axially from a periphery of the circular opening of said disk and engaged with said target ring of said imaging unit at an inner peripheral portion of said opening of said cylindrical portion.

* * * * *